United States Patent [19]

Harrison, Sr.

[11] 4,238,882

[45] Dec. 16, 1980

[54] RESERVOIR SAFETY RAZOR

[76] Inventor: Jack R. Harrison, Sr., 9209 Ferndale Rd., Dallas, Tex. 75238

[21] Appl. No.: 78,984

[22] Filed: Sep. 26, 1979

[51] Int. Cl.[3] ..... B26B 21/00

[52] U.S. Cl. ..... 30/41

[58] Field of Search ..... 30/41

[56] References Cited

U.S. PATENT DOCUMENTS

| | | | |
|---|---|---|---|
| 1,551,388 | 8/1925 | Gross | 30/41 |
| 1,556,269 | 10/1925 | Warming | 30/41 |
| 1,991,405 | 2/1935 | Merriman | 30/41 |
| 2,747,273 | 5/1956 | Olsson | 30/41 |
| 2,786,270 | 3/1957 | Orlando | 30/41 |
| 2,839,224 | 6/1958 | Lipka | 30/41 X |
| 3,417,468 | 12/1968 | Miyauchi | 30/41 |
| 3,648,366 | 3/1972 | Harrison | 30/41 |

*Primary Examiner*—Jimmy C. Peters
*Attorney, Agent, or Firm*—Dowell & Dowell

[57] ABSTRACT

A reservoir safety razor including a handle attached to a body portion which includes a large transparent reservoir opening away from the handle and closed by a head which supports a razor blade held in place by a cap member, the reservoir being filled through a tube extending from an open end near the handle into the reservoir and ending near the head, the head having a valve which can automatically close the tube when the reservoir is properly filled and having capillary-size ports leading from the surfaces of the head adjacent the reservoir to the surfaces of the razor blade which overlie the ports.

9 Claims, 5 Drawing Figures

RESERVOIR SAFETY RAZOR

FIELD OF INVENTION

This invention relates to safety razors of the type having a shaving-liquid reservoir, and more particularly relates to such razors wherein the shaving liquid is fed at a controlled rate, and mainly during actual shaving with the blade in contact with the skin.

PRIOR ART

There are a great many reservoir type razors which have been disclosed in the prior art and which serve the basic purpose of containing a quantity of shaving liquid, such as water or some suitable mixture, and which feed this shaving liquid to the vicinity of the cutting blade edge so that the skin will be moistened during shaving.

For example, U.S. Pat. No. 1,991,405 to Merriman shows a razor having a reservoir with small channels leading therefrom to a position between the razor blade and the guard, and having filling openings facing toward the handle of the razor through which the reservoir can be filled, the razor using capillary action in an effort to limit the rate of flow of the shaving liquid from the reservoir.

U.S. Pat. No. 1,556,269 to Warming shows a razor having a reservoir in the handle connected by channels to the vicinity of the razor blade at the guard, and using a porous packing to limit the rate of flow of the shaving liquid from the reservoir.

My U.S. Pat. No. 3,648,366 is also of the type which uses capillary action in ports passing between the blade and the reservoir to slow up the rate of flow of the shaving liquid to the blade, this patent also showing tube means to prevent some of the liquid from running back out of the reservoir if the razor is titled into a position which brings the liquid toward the filling tube.

There are also a number of patents showing razors having larger reservoirs capable of holding a larger quantity of shaving liquid, but most of these use moveable valves for the purpose of selectively feeding shaving liquid to the vicinity of the blade at a rate which is manually controlled. Examples of such razors are shown in U.S. Pat. No. 2,786,270 to Orlando et al; U.S. Pat. No. 2,839,224 to Lipka, and U.S. Pat. No. 3,417,468 to Miyauchi.

THE INVENTION

The present disclosure is directed toward a safety razor of a type which uses a standard double-edge blade supported between a guard and a cap, the guard comprising a head which closes a rather large reservoir for holding shaving liquid. The head has a series of capillary ports extending through it from liquid-trapping depressions in the head, and the razor blade directly overlies these ports and is essentially in contact with them. The reservoir itself has a filling tube which extends through the reservoir toward the head and opens outwardly of the reservoir at the end thereof which is adjacent to the handle of the razor, whereby shaving liquid can be run into the reservoir through the filling tube. A special valve means is carried by the head which cooperates with and closes the filling tube and keeps it closed regardless of the position of the razor, once the filling tube is partially filled with shaving liquid. The value is held in the closed position by gravity when the razor is upright with the handle facing downwardly, and the valve floats upwardly to close the filling tube when the razor is held with the handle extending upwardly, liquid surface tension tending to keep the valve closed against the end of the filling tube when the razor is rotated through other positions intermediate of the above discussed orientations. The escape of the shaving liquid is thereby prevented through the filling tube, but liquid feed occurs at a very controlled rate through the ports which the razor blade overlies, the ports being opened and closed with a sort of pumping action as the razor flutters slightly against the head during actual shaving. The rate of feed of the liquid from the reservoir is further controlled by the fact that when some of the liquid has left the reservoir which is closed by the valve, a slight vacuum is drawn in the reservoir, whereby external air pressure tends also to oppose easy flow of the shaving liquid through the ports adjacent the razor blade.

OBJECTS AND ADVANTAGES OF THE INVENTION

It is a principal object of this invention to provide an improved reservoir razor which can be filled through a built-in tube and which will then seal itself by an automatic valve action, whereby as liquid is withdrawn from the reservoir into the vicinity of the blade a slight vacuum will develop in the reservoir to oppose easy flow of liquid therefrom, and wherein the razor blade itself overlies the ports extending from the reservoir to the blade and tends to oppose flow of liquid from the ports until such time as the blade is caused to flutter slightly relative to the head while the user is in the act of shaving.

It is another object of the invention to provide a reservoir razor having a valved filling tube extending into the reservoir and having a breather duct located away from the shaving head so that air can escape from the reservoir through the duct during filling, however, the duct being of such small diameter that as soon as liquid contacts the duct it tends to seal it because the surface tension of the liquid prevents it from escaping therethrough.

Still a further major object of the invention is to provide a reservoir razor wherein the liquid in the reservoir will not continuously escape, but will cease flowing as soon as a slight vaccum in built up in the reservoir, although further liquid feed will start despite such slight vacuum when the razor blade is scraped over the beard, causing it to flutter slightly against the head ports extending from the reservoir to the blade in the vicinity of its sharpened edges.

Still another object of the invention is to provide a razor having a transparent reservoir so that the operator can easily see when the reservoir has been filled approximately half way with shaving liquid.

It is another object of the invention to provide a razor having a relatively large reservoir whose cross-section is about equal to the length and width dimensions of the standard double edge blade, and the reservoir depth being somewhere in a range between the length and the width of the standard blade, whereby a sufficient quantity of shaving liquid is contained for one complete shaving operation.

Still another object of the invention is to provide a reservoir razor wherein the inner surface of the head, which closes the reservoir and through which the capillary ports extend, includes a series of waffle-like depressions communicating with said ports and operative to retain shaving liquid in the vicinity of the ports over a greater angle of tipping of the razor during shaving operations, whereby to reduce the tendency of some ports to be dry while others are wet.

A further object of the invention is to provide a razor in which the head portion which carries the blade and the capillary ports is easily disassembled from the reservoir so that the parts can be thoroughly washed to prevent clogging of the capillary ports and other spaces in the vicinity of the blade after the razor has been used.

Other objects and advantages of the invention will become apparent during the following discussion of the drawings.

THE DRAWINGS

DESCRIPTION OF PREFERRED EMBODIMENT

Figure 1:
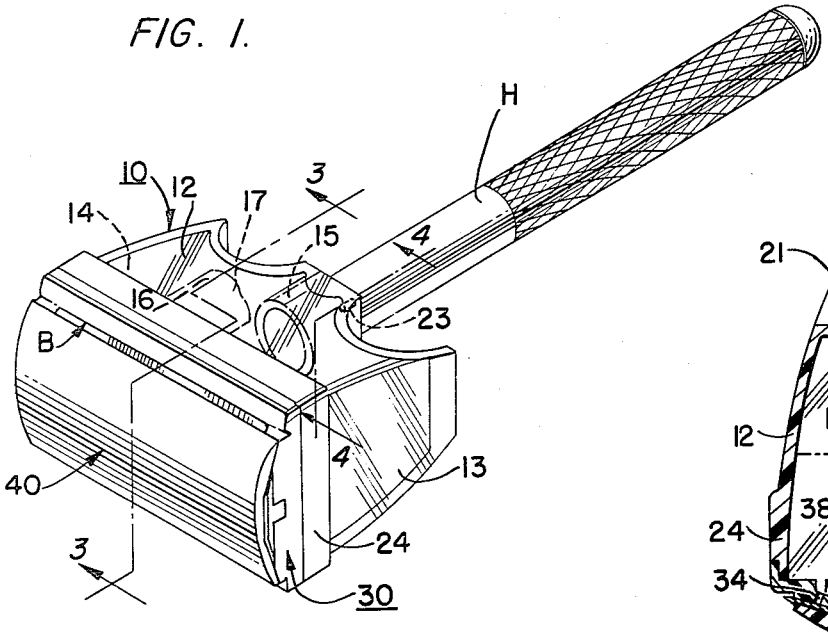
FIG. 1 is a perspective view of a reservoir safety razor according to the present invention.
Figure 2:
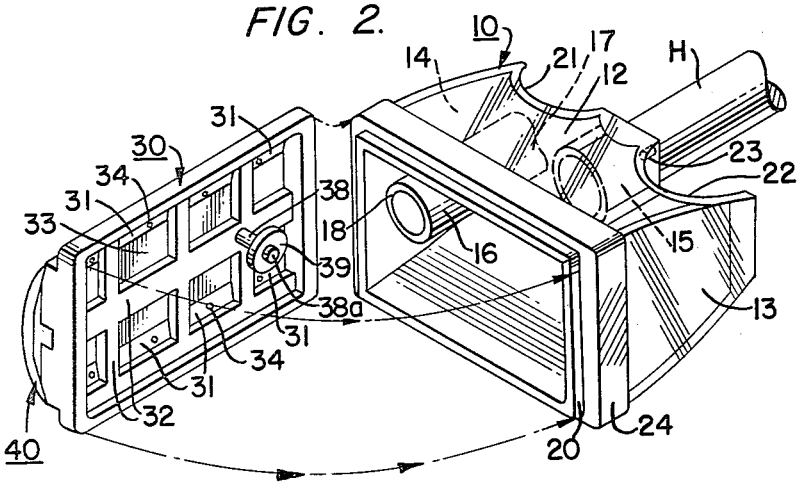
FIG. 2 is a perspective exploded view of the same razor wherein the head is removed from the reservoir.

Referring now to the drawings, FIGS. 1 and 2 show perspective views of the preferred embodiment of the razor which includes a handle H attached to a body portion including a transparent reservoir 10, the reservoir being closed by a removeable head 30 which in turn supports a razor blade B held against the head 30 by an arcuate-shaped cap 40.

Figure 3:
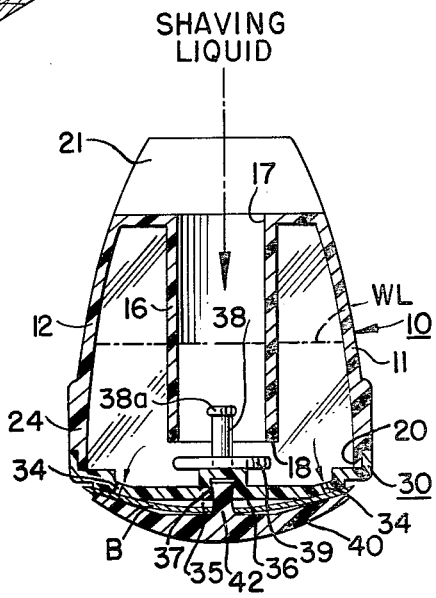
FIG. 3 is a cross-sectional view taken along line 3—3 of FIG. 1.
Figure 4:
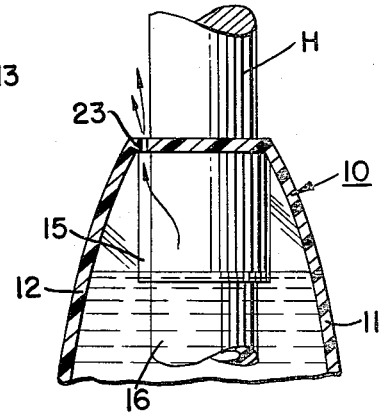
FIG. 4 is a partial cross-sectional view taken along line 4—4 of FIG. 1.
Figure 5:
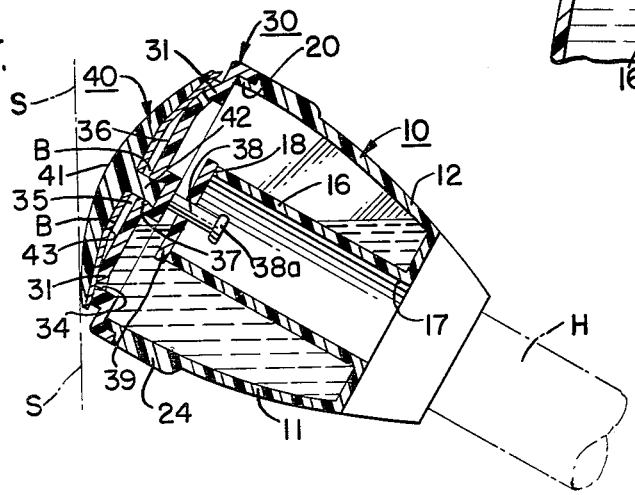
FIG. 5 is a perspective view similar to FIG. 3 but showing the razor inclined at a shaving angle and held against the skin.

The reservoir comprises a one-piece transparent molded plastic member having front and rear faces 11 and 12 and having side faces 13 and 14. The reservoir has a central tubular bore 15 in which the handle H is securely fitted so that it is not removeable from the reservoir. As can best be seen in FIGS. 2, 3 and 5, the reservoir also includes a filling tube 16 which opens into the atmosphere at its outer end 17 through one end of the reservoir alongside the handle and terminates at its inner end 18 facing toward but somewhat short of the plane of rectangular mounting flange 20 which supports the head 30 crosswise of the handle when snapped onto the flange so that the head 30 occupies a reservoir-closing position as illustrated in FIGS. 1, 3 and 5. The end surface of the reservoir nearest the handle is scalloped as shown at 21 and 22, and a very small breather duct 23 extends outside the resevoir into the atmosphere to let air out while the reservoir is being filled through the tube 16 with the razor in the handle-up position as shown in FIGS. 3 and 4. The air duct 23 is so small that the surface tension of the shaving liquid will not permit it to pass through the duct. In practice, the duct is about 0.020 inch in diameter. The opening at the end of the reservoir is further strenthened in the vicinity of the flange 20 by a boss 24 which extends all the way around it.

The opening of the reservoir 10 in the vicinity of the flange 20 and the boss 24 is closed during use of the razor by the head 30 which snaps onto the flange 20 and is a tight enough mate therewith so that it is frictionally retained in place, but removeable by hand for cleaning purposes. The head 30, as can best be seen in FIGS. 2 and 5 has two inclined surfaces 31 against which the razor blade B is compressed by the cap 40. These inclined surfaces 31 are integrally molded with a reinforcing web 32, FIG. 2, which leaves a series of waffle-like depressions 33 which communicate with capillary-size ports 34 extending through the inclined surfaces 31. Thus, when the razor is oriented in a handle-up position as shown in FIG. 3, the liquid within the reservoir 10 fills the waffle-like depressions 33 and is conducted by the ports into contact with the flat surface of the razor blade B near its sharpened edges. The ports and the space between the razor blade B and the inclined surfaces 31 act as capillary zones conducting shaving liquid into the space 35 between the razor blade B and the outer surfaces 36 of the head member 30.

A plastic cap member 40 holds the razor blade B in place. The cap member 40 has an arcuate surface 41 which contacts the skin S of the user as shown in FIG. 5. The cap 40 also has a longitudinal tongue 42 which fits into a groove 37 in the head 30, the tongue and groove joint being held together by suitable means which may comprise either the shaping of the tongue and groove members, or may comprise bonding of one to the other in any suitable way. If the cap is not removeable from the head, then the whole cap and head assembly must be replaced when the blade is worn out. Otherwise, the blade can be replaced by an ordinary double-edged razor blade in cases where the tongue 42 is removeable from the groove 37.

The inner surface 43 of the cap member 40 urges the blade close to the outer surface 36 of the head member overlying the ports 34, but not so tightly that the blade is prevented from slightly fluttering during actual shaving operation. Such fluttering of the blade against the inclined surface 31 results in a kind of pumping action which, together with the capillary action in this vicinity, tends to pump the shaving liquid toward the tip of the blade so as to keep the skin moist. When no shaving is actually being done, this fluttering action stops so that the liquid tends not to be conducted toward the shaving edges. Thus liquid within the reservoir tends to flow during actual shaving action, but to stop when the razor is merely being held with the head down as shown in the position of FIG. 3.

In addition, the head 30 carries a small stem 38 as can be seen best in FIGS. 2, 3 and 5, the stem supporting a small valve disc 39, and having a knob 38*a* which captivates the valve disc 39 on the stem 38, the hole through the disc being large enough so that the disc 39 is a sliding fit on the stem 38. When the head 30 is attached to the reservoir, the valve disc 39 can be either in an open position as shown in FIG. 3 wherein the valve disc is out of contact with the inner end 18 of the tube 16, or else the valve disc can be in a closed position as shown in FIG. 5 wherein it is in contact with the end 18 of the tube 16, thereby closing it. The valve disc 39 is made of a light-weight buoyant plastic so that it will float upwardly when the razor is in the position shown in FIG. 3 after partially filling the reservoir. However, during filling the entering liquid depresses the valve disc 39, FIG. 3, downwardly to open the valve and the air in the reservoir escapes through the duct 23. As soon as the user stops filling shaving liquid through the tube 16, the valve disc 39 floats upwardly and seals against the inner end 18 of the tube 16. The action of the valve disc 39 will be more clearly described when the operation of the razor is discussed hereinafter.

OPERATION

With the various parts assembled in their operative positions as shown in FIG. 1 of the drawings, the razor is held under a water faucet or other source of shaving liquid with its handle upright, and liquid is introduced into the reservoir 10 through the tube 16. The valve plate 39 is of course depressed by the entering liquid into the position shown in FIG. 3, leaving the inner end 18 of the tube 16 open to pass the shaving liquid into the reservoir. The reservoir is filled approximately halfway, to the water level marked WL in FIG. 3, and while filling is proceeding air escapes from the reservoir as shown in FIG. 4 through the duct 23 as illustrated by the small arrows. When the reservoir is about half full, the filling is stopped. As soon as the flow of liquid downwardly through the tube 16 ceases the valve disc 39, being buoyant, floats upwardly and closes against the inner end of the tube 16. Also, the shaving liquid tends to fill the ports 34 which can be seen best in FIGS. 2, 3 and 5. Some of the shaving liquid passes through the ports 34 and wets the space 35 between the adjacent surfaces of the razor blade B and the head member 36.

The razor can then be rotated to any position in which shaving is to be accomplished, for example as shown in FIG. 5. Immediately after filling, when the razor is turned with its handle extending downwardly, the small quantity of shaving liquid inside the tube 16 adjacent to the valve disc 39 will fall out of the end 17 of the tube 16. However, since the disc 39 is closed against the end 18 of the tube 16, the tube will remain sealed as shown in FIG. 5 so that no further shaving liquid will escape therethrough. Moreover, since the duct 23, FIG. 4, is too small to pass the shaving liquid, the liquid will not escape from the reservoir through the duct 23. As a result, a vacuum tends to build up in the reservoir as some of the liquid is fed through the ports 34 so that an equilibrium is quickly reached tending to oppose further feed of the liquid through the ports. However, as soon as the person begins shaving, the sharpened edge of the razor blade B will begin a small fluttering action between the cap 40 and the inclined surface 31 as shown in FIG. 5, whereby a small amount of water will be urged to pass from the space 35 outwardly to the skin S of the user. Since the quantity of shaving liquid is being depleted within the reservoir, the vacuum will still tend to build up during shaving, and it will be sufficient when balanced against the outside air pressure to resist the flow of liquid into the space between the blade B and the inclined surface 31, thereby tending to control the rate of flow of the liquid to the face of the user. This action is not sufficient to prevent the flow of liquid, but it is sufficient to prevent undesirable drippage of the water from the blade when the razor is held with the handle up and the blade down in the position of FIG. 3. Therefore, the water does not freely drip from the reservoir, but instead only seeps from the space behind the blade at a very slow rate, and then only at such times as the user is actually shaving and causing the blade to flutter, which fluttering produces a slight pumping action. As a result, there is no undesired drippage from the razor, whereas a slow flow of the shaving liquid resumes each time the user begins shaving again.

It is significant to carefully note the action of the valve disc 39. When the razor is held with the handle down and the blade up, obviously the valve disc 39 will drop downwardly toward the enlargement 38*a* on the stem 38 and against the end 18 of the tube, thereby closing the tube 16. The disc is of course wet, and the surface tension of the liquid tends to hold the disc against the end 18 of the tube 16 even as the razor is tilted to an intermediate position as shown in FIG. 5. As the razor is tilted further by raising the handle and lowering the head, the liquid in the reservoir tends to cover the disc, and since the disc is buoyant, it floats upwardly so that it still keeps the end of the tube 16 closed. As a result, once the reservoir has been filled to the level WL, the disc 39 keeps the filling tube 16 continuously closed, and therefore there is no loss of shaving liquid outwardly through the tube 16. The razor thus filled can be turned to any position without loss of liquid due to undesirable drippage through the tube 16, and yet the reservoir can be refilled at any time simply by adding further liquid through the tube 16 which forces the valve open when the handle of the razor held upwardly in the position of FIG. 3.

Moreover, since the reservoir is sealed by the disc and by a droplet of water in the duct 23, as soon as enough liquid has escaped through the capillary ports 34 to draw a small vacuum in the reservoir, the drippage at the blade will also cease. An equilibrium has therefore been reached. As pointed out above, as soon as the user resumes shaving liquid will pass between the fluttering blade and the inclined surface 31 and wet the user's face, such feed stopping as soon as actual shaving ceases.

This invention is not to be limited to the exact form shown in the drawings, for obviously changes may be made therein within the scope of the following claims.

I claim:

1. A reservoir safety razor of the type including a handle and a body portion attached to the handle and operative to contain a shaving liquid and to support a razor blade oriented crosswise of the handle, said body portion comprising:

- a reservoir fixed at one end to the handle and having an opening extending across the other end of the reservoir and oriented crosswise of the handle;
- a filling tube in the reservoir passing through said one end thereof alongside the handle and extending substantially to and facing toward said opening;
- a head removeably attachable to said reservoir to close said opening, the head having outer surfaces oriented crosswise of the handle and supporting said blade in operative shaving position, the head having multiple capillary-size ports extending from the reservoir through said outer surfaces and into communication with surfaces of the blade which overlie the ports;
- a cap supported by the head and overlying the blade to urge it toward said outer surface; and
- valve means supported by the head and moveable toward and away from the filling tube, the valve means being buoyant in the saving liquid so that it tends to close the filling tube when the razor is held with its handle extending upwardly.

2. A razor as claimed in claim 1, wherein said head has an inner surface facing toward the opening of the reservoir and has a series of waffle-like depressions each coinciding with the location of a port to retain shaving liquid at the corresponding ports when the razor is tipped sideways during shaving.

3. A razor as claimed in claim 1, wherein said outer surfaces of the head are inclined with respect to a plane disposed normal to the handle, said cap urging the blade toward contact with said outer surfaces.

4. A razor as claimed in claim 3, wherein said ports pass through said outer surfaces near the cutting edges of the razor blade.

5. A razor as claimed in claim 1, wherein said valve means comprises a stem attached to the head and oriented to extend into the filling tube when the head is attached to the reservoir; and a valve disc having a central hole therethrough receiving said stem, the disc being of a diameter to close the tube when urged thereagainst by gravity when the razor handle is downwardly oriented and to close the tube by flotation on the shaving liquid when the razor handle is upwardly oriented.

6. A razor as claimed in claim 1, wherein the reservoir has a duct extending through said one end of the reservoir adjacent the handle, the diameter of the duct being sufficient to pass air but insufficient to pass shaving liquid.

7. A razor as claimed in claim 1, wherein said reservoir is made of a transparent material.

8. A razor as claimed in claim 1, wherein the reservoir has a flange extending around its opening, said head being shaped to mate with the flange and be frictionally secured thereto.

9. A razor as claimed in claim 1, wherein said razor blade is a standard double-edge blade, said opening in the reservoir approximating the length and width dimensions of the blade and the depth dimension of the reservoir as measured from the opening toward the handle being within a range falling between said length and width dimensions.

* * * * *